US005365823A

United States Patent [19]

Leonard

[11] Patent Number: 5,365,823

[45] Date of Patent: Nov. 22, 1994

[54] IN-LINE DOUBLE ATTACHMENT SLIDE TROMBONE

[75] Inventor: B. P. Leonard, Akron, Ohio

[73] Assignee: The University of Akron, Akron, Ohio

[21] Appl. No.: 63,239

[22] Filed: May 18, 1993

[51] Int. Cl.[5] ..... G10D 7/10

[52] U.S. Cl. ..... 84/395; 84/394; 84/396

[58] Field of Search ..... 84/393, 394, 395, 396, 84/453, 388

[56] References Cited

U.S. PATENT DOCUMENTS

| | | | |
|---|---|---|---|
| 468,116 | 2/1892 | Robinson | 84/395 |
| 2,027,340 | 1/1936 | Holton | 84/395 |
| 2,093,993 | 9/1937 | Adriani | 84/395 |
| 3,631,755 | 1/1972 | Glantz et al. | 84/394 X |
| 3,903,779 | 9/1975 | McCracken | 84/395 |
| 3,903,779 | 9/1975 | McCracken | 84/395 |
| 4,273,020 | 6/1981 | Happe | 84/394 |
| 4,831,911 | 5/1989 | Wanner | 84/395 |
| 4,993,303 | 2/1991 | Clark | 84/394 |

FOREIGN PATENT DOCUMENTS

| | | |
|---|---|---|
| 1293357 | 4/1962 | France . |
| 424455 | 5/1991 | France . |

*Primary Examiner*—David M. Gray
*Assistant Examiner*—Patrick J. Stanzione
*Attorney, Agent, or Firm*—Hudak & Shunk Co.

[57] ABSTRACT

A slide trombone is provided having a complete chromatic range extending from the tenor range to the pedal notes of the basic B♭ windpath. The trombone of the present invention includes two trigger activated attachments which are "in-line." The first attachment is thumb activated to lower the pitch of the basic windpath by a minor third. The second attachment is finger activated to lower the basic windpath by approximately six semitones so that the two attachments together lower the basic windpath by a minor sixth.

5 Claims, 3 Drawing Sheets

Bb/F/Gb/D

Bb/G/E/D

IN-LINE DOUBLE ATTACHMENT SLIDE TROMBONE

FIELD OF INVENTION

The present invention relates to trombones, and more particularly to a slide trombone having an in-line double attachment which achieves better technical facility and a complete chromatic range. More particularly, the trombone has two independently operated trigger attachments wherein a thumb trigger operates an attachment lowering the windpath by a minor third and a finger trigger operates a second attachment lowering the windpath by approximately a tritone so that the two attachments together lower the windpath by a total of a minor sixth.

DESCRIPTION OF THE PRIOR ART

The slide trombone is a brass wind instrument which relies on varying the length of tubing through which air passes to vary the pitch of the resulting sound. Generally, a slide trombone player will vary the length of tube and the resulting sound pitch by selectively telescoping the trombone slide relative to the bell portion of the trombone.

The conventional trombone has a mouthpiece mounted on a fixed length of straight tubing. The trombone also includes a bell from which the sound emanates when the instrument is played. A second fixed length of straight tubing is coupled on one end through a U-shaped section of tubing to the bell. The free end of each of the fixed lengths of tubing, or receivers, terminates in a raised angular section or lip called a stocking. A U-shaped section of tubing forming a "slide" provides two leg portions, each having an inner diameter slightly greater than the outer diameter of the stockings of the fixed length straight members of the tubing. The slide is slidably mounted on the two fixed-length straight tube members by slipping the slide legs over the inner tube stockings. Lubricant is applied to the stockings before the instrument is played and permits the slide to ride freely along the inner tube members by varying the length of the tubing through which air travels between the mouthpiece and the bell of the trombone. Extending the tube length of the instrument by a slide rather than by valves, permits a continuous, rather than discrete change in pitch, which provides a sound unique to the trombone as compared to other wind instruments.

Prior to 1839, the tone sounded by trombones was generally achieved by changing the embouchure and the slide position. In 1839, a thumb-actuated valve was invented by Sattler, in Leipsig. At the time of the invention of this thumb-actuated valve, a nominal trombone section consisted of an alto in E♭, a tenor in B♭, and a bass in F (i.e., a grouping in perfect fourths). Thus, it was logical to combine the two traditional B♭ and F instruments into a single design by adding an F attachment to the standard B♭ trombone. Accordingly, it is now quite common for B♭ trombones to include an F attachment.

Unfortunately, the standard length B♭ slide is not quite long enough to accommodate a true low $C_2$ (with the attachment actuated), although professional players compensate for this deficiency by embouchure adjustment. The low B# (played in the seventh position on the large F bass trombone), is missing on the B♭/F combination.

When the B♭/F instrument is used as a bass trombone, various strategies have been devised to accommodate the low B♭. Prior to the 1960's, this usually involved the "E pull" tuning slide within the F loop. Playing technique requires identification of passages involving the low B# ahead of time, then, during an appropriate rest in the music, manually extending the tuning slide from F to E#, negotiating the particular passage using different slide positions and using embouchure adjustment for the otherwise quite sharp B#; then during another rest, returning the tuning slide to F for remaining passages not containing the low B#. In the 1960's, a second valve also operated by the left thumb in an awkward rolling sliding motion was available in some commercial designs. This is sometimes referred to as a side-by-side design. The second trigger, which can only be actuated in conjunction with the first, actuates additional tubing within the F loop, instantly converting it to an E# attachment. While the playing technique of this design is less cumbersome, the low B# still requires considerable embouchure adjustment just as in the E-pull technique. Modern tuning of the second attachment in E♭ or D are available which provides for the low B# in a closer position; however, this design still requires the awkward thumb motion.

Also during the mid 1960's, the concept of an "in-line" independently actuated dual trigger double valve design appeared. The first commercial design manufactured by Alexander (the so-called "Cimbasso" instrument) was designed by Kunitz in 1963. A further example of this is shown in French Patent No. 1,293,357. However, this design was not applied to the B♭ instrument, but rather to a large F bass trombone. The more commonly used thumb trigger actuates an attachment lowering the tuning by a perfect fourth to C, the independent middle finger actuated attachment lowers the pitch by a minor third to D, and the two actuated together put the instrument in a low B♭, thereby producing a true contra-bass trombone with a complete chromatic range and an abundance of alternate positions in the low register. However, the size and weight of this instrument calls for considerable physical endurance on the part of the player. The same principles have been applied to the B♭ bass trombone, producing a B♭/F/G/E♭ or alternatively B♭/F/G♭/D design in which the "traditional" F attachment is operated by the left thumb, and the finger trigger attachment is tuned to either G# or G♭ and the two together produce E♭ or D, respectively. Although this design provides a solution to the missing B#, the positions with the more often used thumb trigger activated F attachment are no more convenient than for the single trigger F attachment design. A G# attachment offers more convenient alternate positions; this is most appropriately activated by the more commonly used thumb trigger. However, a G-attachment alone does not provide a full chromatic range. Accordingly, a second independent finger trigger attachment is used to complete the chromatic range. This second attachment is preferably tuned approximately to E# so that the combined attachment with both triggers activated is in D. Moreover, this advantageous design can be manifested using a short reach low-inertia slide.

DETAILED DESCRIPTION OF THE INVENTION

Figure 1:
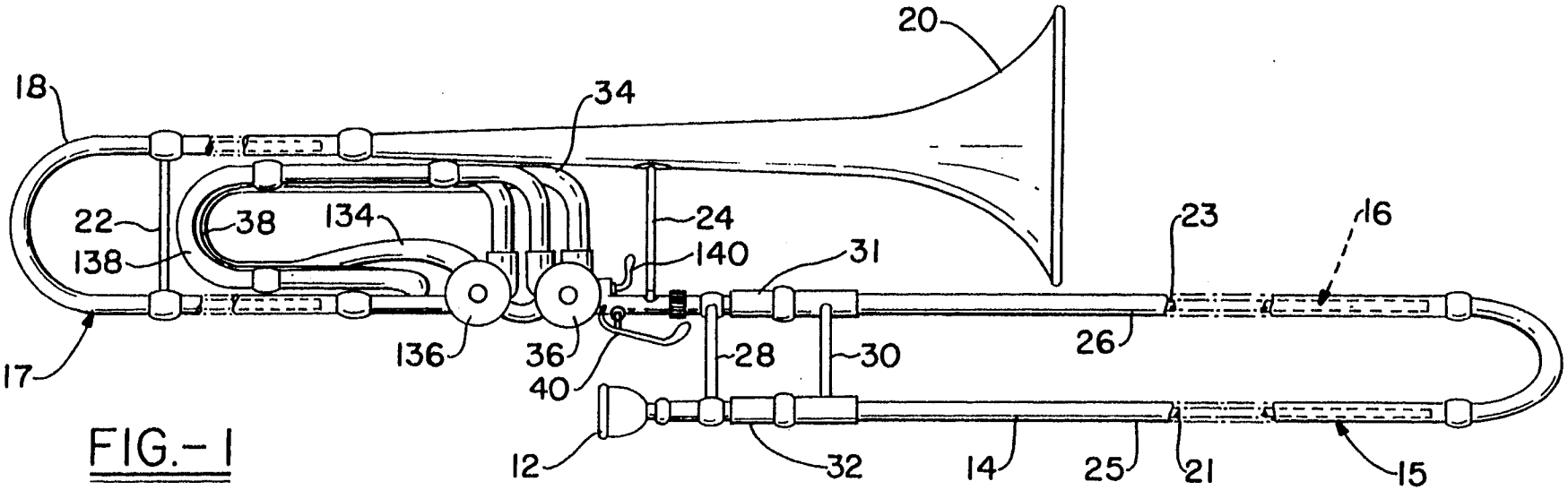
FIG. 1 is a drawing of an in-line double attachment B♭/G/E/D trombone in accordance with the invention.

FIG. 1 shows a short reach slide double trigger trombone in accordance with the present invention. The trombone includes a basic windpath which comprises a slide assembly 15, a tuning loop 17, a mouthpiece 12, and a bell 20. The slide assembly 15 includes an inner slide 16 which has two generally parallel inner tubes, 21, 23. One inner tube 21 is joined to the mouthpiece 12, while the other inner tube 23 is joined to the tuning loop 17.

Figure 2:
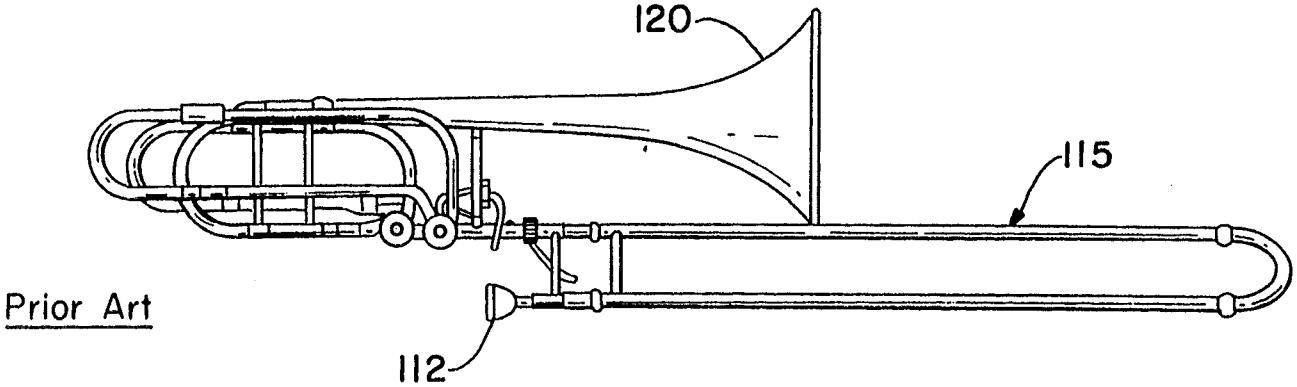
FIG. 2 is a drawing of an in-line double attachment B♭/F/G♭/D trombone of the prior art having a conventional length slide.

FIG. 2 illustrates a prior art double trigger trombone having a conventional length slide.

The slide assembly 15 also includes a generally U-shaped outer slide 14, which includes two generally parallel outer tube members 25, 26, which are in telescoping engagement with the inner tubes 21, 23 of the slide assembly. The outer slide 14 glides along the inner slide 16 to lengthen the length of the windpath and lower the pitch of the trombone accordingly. The pitch of the trombone will depend upon the length of the windpath; the fundamental pitch being the lowest available note for a given windpath. Generally speaking, a lower pitch results from a longer path, however, it should be understood that a trombone will resonate at multiple harmonic frequencies for the same length of windpath. The player selects a given harmonic or tone by adjusting his or her embouchure. The slide position will determine a note selection for any given harmonic. As used herein, "basic pitch" refers to the fundamental pitch which is produced when the slide is in a closed position.

The tuning loop 17 extends from its joint connecting it with the inner slide 16 and has two generally parallel tube portions joined by a tuning bow 18. The tuning bow 18 can be adjusted in and out in order to tune the trombone to a specific frequency. The tuning loop terminates in a bell 20. The loop is stabilized by a tuning slide brace 22 which can optionally include a counter weight to help balance the weight of the slide assembly as the slide is slid from first position outward. The tuning loop further includes a bell brace 24 which can be positioned in front of or behind the hand of the user which bears the weight of the trombone. The slide assembly includes first and second transfer braces 28 and 30 which help stabilize the inner and outer slides, respectively.

The inner slide 16 includes sleeves 31, 32, which receive the outer slide 14 when it is in a closed position. Generally, the sleeves 31, 32 include a positive stop for the outer slide which can include a spring loaded bumper as is known in the art.

The slide is positionable from a closed position to the outermost position. This distance is referred to herein as the "reach" of the slide.

In a further embodiment of the present invention, the slide is a short reach slide, i.e., this slide has a shorter reach than conventional B♭ trombones. Specifically, the slide may be used to lower the basic pitch by five complete semitones, or by four complete semitones when the attachment is activated. The "standard length reach" as is used in the present application, generally encompasses the length of the outer slide from the terminus of the outer slide tubes, 25, 26, to the outer diameter of the U-shaped connecting member 27. More specifically, this reach is the length of the slide movement from first position to the last available position. The standard reach of a B♭ trombone is generally about 62 cm. Whereas in the present invention the reach is not more than 62 cm and is more preferably about 55 cm. In order to keep the tuning of the basic windpath of the trombone in B♭, the length of the tuning bow is adjusted accordingly, i.e., more specifically is lengthened by a corresponding amount that the slide is shortened. The shortening of the slide and corresponding lengthening of the tuning loop causes a shift of the weight distribution of the trombone so that it is most desirably centered in the supporting hand of the player. As a result, the short reach slide embodiment of the present invention allows a more facile playing technique since the player does not need to work against the torque of gravity as the player slides the slide outward. The lower inertia of the shorter slide in this embodiment adds further to technical facility, giving a lighter feel, and the overall weight redistribution leads to better balance and a more comfortable playing position. The shortening of the slide assembly for the trombone of the present invention results in a slide having a reduced number of positions, i.e., the standard slide has seven positions in the basic windpath. In accordance with the present invention, the slide will allow six complete positions in the B♭ windpath.

Figure 3:
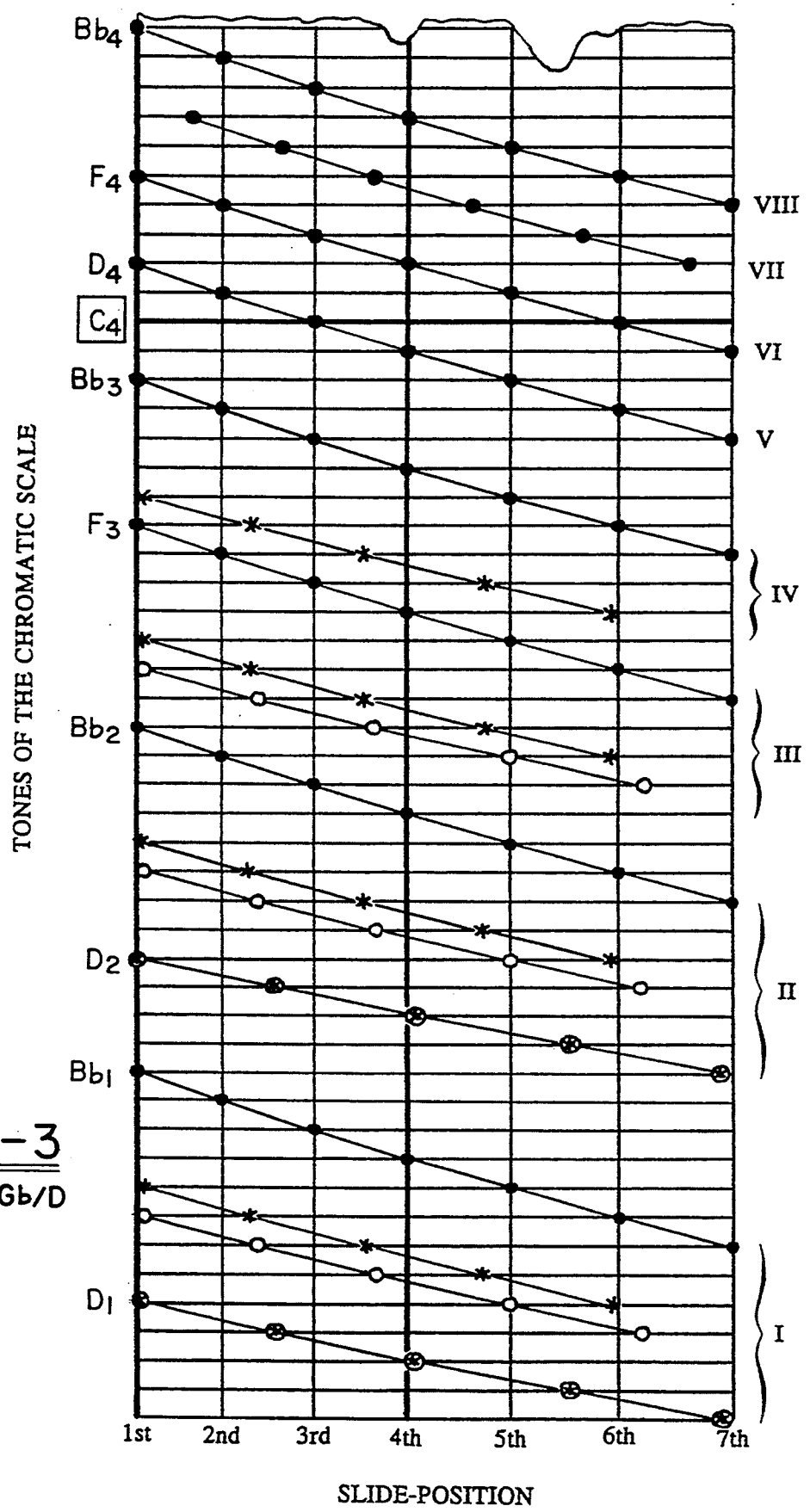
FIG. 3 is the chart of tone versus slide position for the in-line double attachment trombone of FIG. 2.
Figure 4:
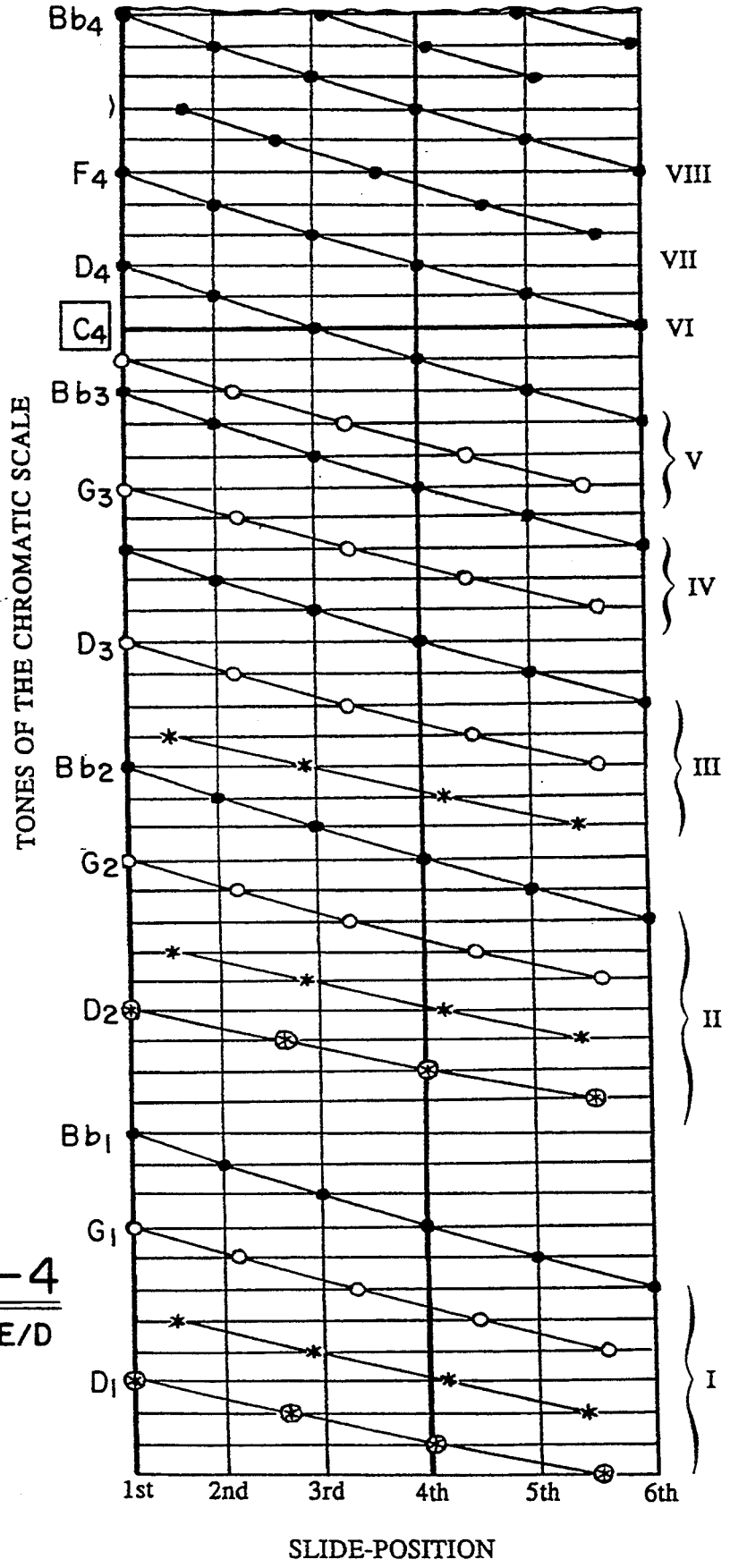
FIG. 4 is the chart of tone versus slide position for the in-line double attachment trombone of the present invention having a short reach slide.

FIGS. 3–4 show a chart of tones versus slide position relevant to the present invention, in which the Y axis represents the closed position of the slide, and the points on that axis are tones which can be played on a trombone with the slide in a closed position. The horizontal lines represent notes of the chromatic scale.

The vertical lines represent relative slide positions for each embodiment of the instrument without the attachments activated, with the first position at the left, the fourth position is emphasized for reference. The distance between the successive slide positions increases toward the right according to a geometric progression. The dots represent all available positions for the indicated tones. Notes belonging to any given "harmonic" designated by a Roman numeral, are joined by sloping lines. Because of non-uniform compression of the harmonic series, many of the upper register's tones do not occur at exactly standard position locations. For example, the seventh, eleventh, and other higher harmonics are displaced.

The trombone of the present invention includes a first tuning attachment 34 and a second tuning attachment 134, each consisting of an assembly including a valve 36, 136 and an attachment tuning loop 38, 138. These valves can be standard valves as is known in the art, such as a rotary valve (i.e., either conventional or Yamaha three port) or a Thayer axial valve, and the configuration of the tuning loop will be configured accordingly to accommodate the wind passage coming out of and into the valves. The first valve is a thumb actuated valve such as by a thumb trigger 40. This attachment is tuned to lower the pitch by a minor third. The second valve 140 is a finger actuated valve. The second attachment lowers the pitch by approximately six semitones so that together both attachments lower the pitch of the basic windpath by a total of a minor sixth. Various trigger mechanisms which are suitable are well known in the art.

Comparing FIG. 3 showing a tone/slide-position chart of the B♭/F/G♭/D trombone of the prior art with FIG. 4 showing a similar chart for the B♭/G/E/D trombone of the present invention, an important advantage of the present invention can be seen, notably that the attachment tones are more evenly distributed and therefore available in more convenient alternate slide positions. A further advantage of the present invention over the prior art is that the more easily manipulated thumb trigger activates the G or minor-third attachment which is preferable in the tenor range. FIG. 4 shows that these advantages can be achieved using a shorter and therefore lighter slide.

While in accordance with the Patent Statutes, the best mode and preferred embodiment has been set forth, the scope of the invention is not limited thereto, but rather by the scope of the attached claims.

What is claimed is:

1. A slide trombone having a basic windpath comprising:

a mouthpiece, a slide assembly, a tuning loop, and a bell, said slide trombone having a first activatable attachment and a second activatable attachment each of which independently and together lengthens the basic windpath to define a lengthened windpath when activated, said slide assembly including a slide which is positionable to lower the pitch of the basic windpath when said attachment is activated whereby the first attachment lengthens the windpath and lowers the pitch of the basic windpath by a minor third, the second attachment independently lengthens the windpath and lowers the pitch by approximately six semitones of the basic windpath, and the first and second attachment together lengthen the windpath to lower the pitch of the basic windpath by a minor sixth.

2. A slide trombone according to claim 1, wherein said first attachment is activatable by means of a thumb trigger.

3. A slide trombone according to claim 2, wherein said second attachment is activatable by means of a finger trigger.

4. A slide trombone according to claim 3, wherein said basic pitch is B♭.

5. A slide trombone having a basic windpath comprising:

a mouthpiece, a slide assembly, a tuning loop and a bell, said slide trombone having a first attachment activatable by a thumb trigger and a second attachment activatable by a finger attachment, an activatable attachment which lengthens the basic windpath to define a lengthened windpath when activated, said slide assembly including a slide which is positionable to lower the pitch of the basic windpath when said attachment is activated whereby the basic windpath is tuned to B♭, the first attachment is tuned to G, the second attachment is tuned to E, and the two attachments together are tuned to D.

* * * * *

UNITED STATES PATENT AND TRADEMARK OFFICE

CERTIFICATE OF CORRECTION

PATENT NO. : 5,365,823

DATED : November 22, 1994

INVENTOR(S) : B. P. Leonard

It is certified that error appears in the above-indentified patent and that said Letters Patent is hereby corrected as shown below:

Column 1 and 2;
Please correct the patent by deleting at every occurrence the "♯" symbol and substituting therefor the --♮-- symbol.

Column 2, line 5, "Bb" should be --B♮--.

Signed and Sealed this

Twenty-third Day of May, 1995

*Attest:*

*Attesting Officer*

BRUCE LEHMAN

*Commissioner of Patents and Trademarks*